United States Patent [19]

Iwase

[11] Patent Number: 5,022,336

[45] Date of Patent: Jun. 11, 1991

[54] PIN TYPE CONVEYOR FABRIC FEEDING APPARATUS FOR A SEWING MACHINE

[75] Inventor: Yukio Iwase, Utsunomiya, Japan

[73] Assignee: Prince Sewing Machine Co., Ltd., Tokyo, Japan

[21] Appl. No.: 343,348

[22] Filed: Apr. 26, 1989

[51] Int. Cl.[5] ..... D05B 35/00

[52] U.S. Cl. ..... 112/304; 112/121.26; 112/306; 112/103; 26/96; 226/53; 226/74

[58] Field of Search ..... 198/692, 693; 226/74, 226/53; 112/304, 121.26, 306, 305, 103, 80.32, 118; 26/96; 271/18.3

[56] References Cited

U.S. PATENT DOCUMENTS

| | | | |
|---|---|---|---|
| 1,238,576 | 8/1917 | Schneebeli et al. | 26/96 |
| 3,500,777 | 3/1970 | Kalning et al. . | |
| 3,887,121 | 6/1975 | Reich | 226/53 |
| 4,434,729 | 3/1984 | Davidson | 112/304 X |
| 4,541,353 | 9/1985 | Engle | 112/304 |

FOREIGN PATENT DOCUMENTS

| | | | |
|---|---|---|---|
| 1485386 | 6/1969 | Fed. Rep. of Germany . | |
| 1550051 | 12/1968 | France . | |
| 15-3821 | 3/1940 | Japan . | |
| 61-312938 | 12/1961 | Japan . | |
| 1-39794 | 6/1988 | Japan . | |
| 61-286234 | 6/1988 | Japan . | |
| 1-58998 | 7/1988 | Japan . | |
| 1-42712 | 1/1989 | Japan . | |
| 62-168115 | 1/1989 | Japan . | |
| 1273348 | 5/1972 | United Kingdom | 26/96 |

*Primary Examiner*—Andrew M. Falik

*Attorney, Agent, or Firm*—Cushman, Darby & Cushman

[57] ABSTRACT

An apparatus for feeding a sewing machine with a textile fabric with opposite side hems. The sewing machine has a needle assembly and a bobbin assembly which are vertically aligned with each other to sew a textile fabric placed at a position between the needle and bobbin assemblies. The feeding apparatus is designed to set and withdraw the fabric into and from said position. The feeding apparatus includes two sets of rotary wheels that can be disposed respectively at the opposite sides of the sewing machine; a pair of loop members wrapped respectively around the two sets of wheels so that elements of each of the loop members can move around the respective sets of wheels with at least one section of their path being horizontal, and each loop member is spaced from and parallel to the horizontal section of the path of the other loop member's elements that move around the sets of wheels; a motor drivingly connected to one of each set of wheels, for driving the elements of the loop member synchronously with those of the other so that, within the horizontal sections of the paths, the loop member's elements are moved in the same direction; and a pair of holding mechanisms, mounted respectively on the loop members, for holding the opposite side hems of the fabric to hold the fabric between the pair of holding mechanisms at the respective horizontal sections of the loop path. Each of the holding mechanisms includes a plurality of spike members disposed around the corresponding loop member, the spike members being pointed upward when the spike members are in the corresponding horizontal section, so as to pierce the corresponding side hem of the fabric horizontally disposed.

6 Claims, 11 Drawing Sheets

PIN TYPE CONVEYOR FABRIC FEEDING APPARATUS FOR A SEWING MACHINE

BACKGROUND OF THE INVENTION

This invention relates to an apparatus for feeding a sewing machine with a textile fabric, more specifically this invention relates to a fabric feeding apparatus which is suitable for clothes, or bedclothes such as thick bed quilts or futon comforters, when they are sewn by a sewing machine.

Conventionally, a futon comforter is made of a front cloth, cotton wadding, and a back cloth. They are made into a unitary futon comforter by a sewing machine. The sewing machine also embroiders and quilts the futon comforter. When the pieces of the futon comforter are sewn by a sewing machine, it is necessary to bring each piece into the sewing position of the sewing machine one by one. In the sewing process, the futon comforter must be outwardly tensed. The sewing machine has a pair of units which are constituted by a plurality of clasps for the apparatus to tension a piece of the futon comforter. These units are disposed on each side of the sewing position, so as to tense the futon comforter. The clasps are like a paper clasp or clothespin.

It is necessary to bring each piece of the futon comforter into the sewing position one by one, and to let the clasps clip hems of the futon comforter. When the sewing process is finished, it is necessary to release the clasps and to bring out the futon comforter. Hence, there is the problem that much time is spent for preparing and unfastening the futon comforter. There has not been provided a fabric feeding apparatus for sewing machines which is suitable for continuous feeding and continuous sewing.

The clasps cannot permanently clip the futon comforter. The futon comforter increasingly slackens because the futon comforter draws against the clasps by its own weight. The slack interferes with the sewing process. The width of the futon comforter gradually shrinks during the sewing process. Frequently, the futon comforter falls from the clasps. For preventing comparably heavy futon comforters from falling, many clasps are required. However, the number of clasps is limited because of the width of the claw ends of the clasps.

Because the hems held by the clasps are damaged by the clasp's claw ends, the hems must be cut off and wasted. For a firm grip by the clasps, the clasps must clip large hems of the futon comforter. Therefore, when clasps are utilized, much cloth is wasted.

SUMMARY OF THE INVENTION

Accordingly, it is an object of the present invention to provide a fabric feeding apparatus for sewing machines, which can continuously feed the fabric into the sewing machine, thereby shortening the time for preparing and unfastening the fabric, such as a futon comforter.

It is another object of the present invention to provide a fabric feeding apparatus for sewing machines which can steadily and permanently tense the fabric.

A further object of the present invention is to provide a fabric feeding apparatus for sewing machines, which can reduce wasted cloth.

A fabric feeding apparatus for sewing machines, according to the present invention is of a type for feeding a sewing machine with a textile fabric having opposite side hems. The sewing machine has a needle assembly and a bobbin assembly which are vertically aligned with each other to sew a textile fabric placed at a position between the needle and bobbin assemblies. The feeding apparatus is designed to set and withdraw the fabric into and from the position. The feeding apparatus includes two sets of rotary wheels that can be disposed respectively at the opposite sides of the sewing machine; a pair of loop members wrapped respectively around the two sets of wheels so that elements of each of the loop members can move around the respective sets of wheels with at least one section of their path being horizontal, and spaced from and parallel to the horizontal section of the path of the other loop member's elements; motor drivingly connected to one of each set of wheels, for driving the elements of the loop member synchronously with those of the other so that, within the horizontal sections of the paths, the loop member's elements are moved in the same direction; and a pair of holding mechanisms, mounted respectively on the loop members, for holding the opposite side hems of the fabric to hold the fabric between the pair of holding mechanisms at the respective horizontal sections of the loop paths, each of the holding mechanisms including a plurality of spike members disposed around the corresponding loop member, the spike members being pointed upward when the spike members are in the corresponding horizontal section, so as to pierce the corresponding side hem of the fabric horizontally disposed.

The fabric feeding apparatus for sewing machines in accordance with the present invention can provide continuous feeding of the fabric into the sewing machine so that time for preparing and unfastening the fabric for the sewing machine is reduced. The apparatus can provide firm and constant holding force to the fabric to be sewn because it uses spike means as holders. If more holding force is necessary, the number of spike means and the number of spike means per length can be increased. Thereby the holding force and holding force per length can be increased. Spike means need less hems of the fabric in order to hold the fabric as compared with conventional clasps like clothespins. Wasted cloth can be reduced. The apparatus can further provide lateral tension to the fabric because it uses the adjusting means. Even if the fabric increasingly shrinks, the apparatus can constantly provide enough lateral tension.

DETAILED DESCRIPTION OF THE PREFERRED EMBODIMENTS

Figure 1:
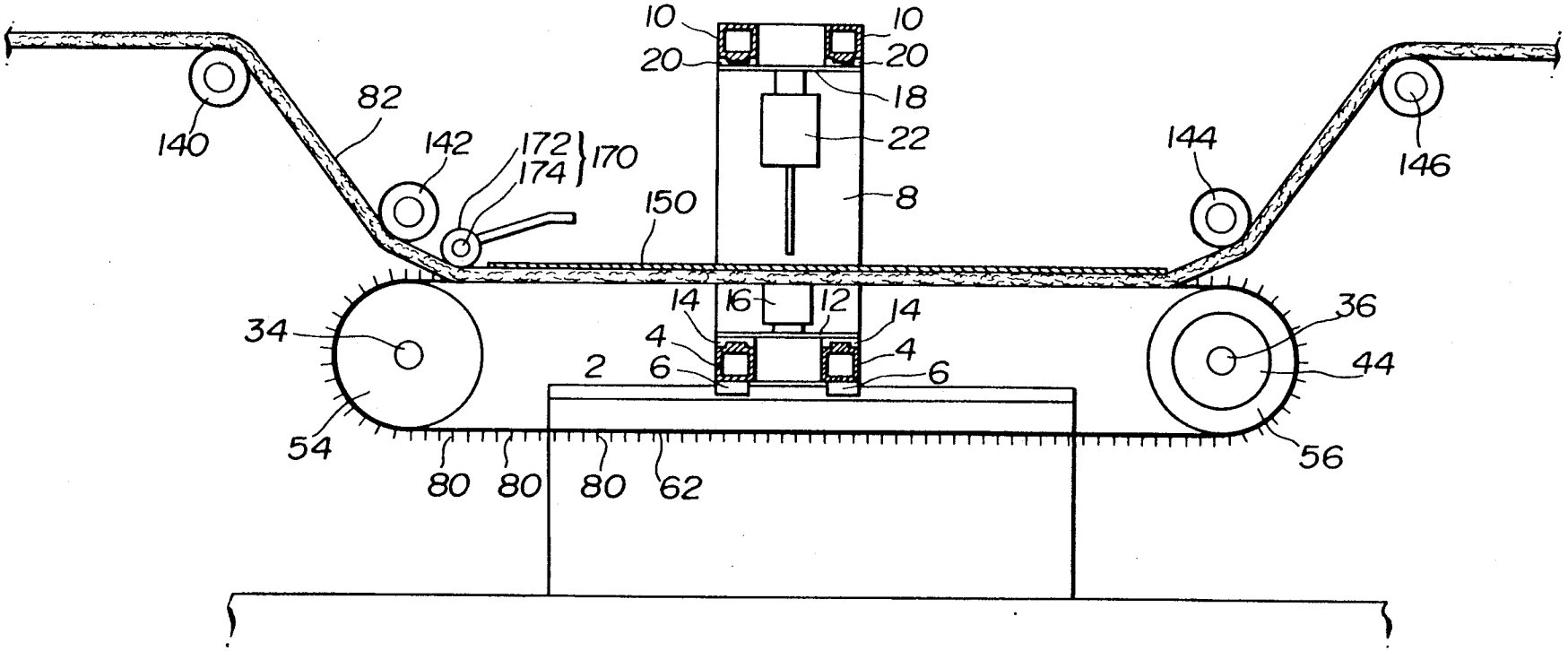
FIG. 1 is a schematic side sectional view showing a sewing machine including a fabric feeding apparatus for sewing machines according to a first embodiment of the present invention.
Figure 2:
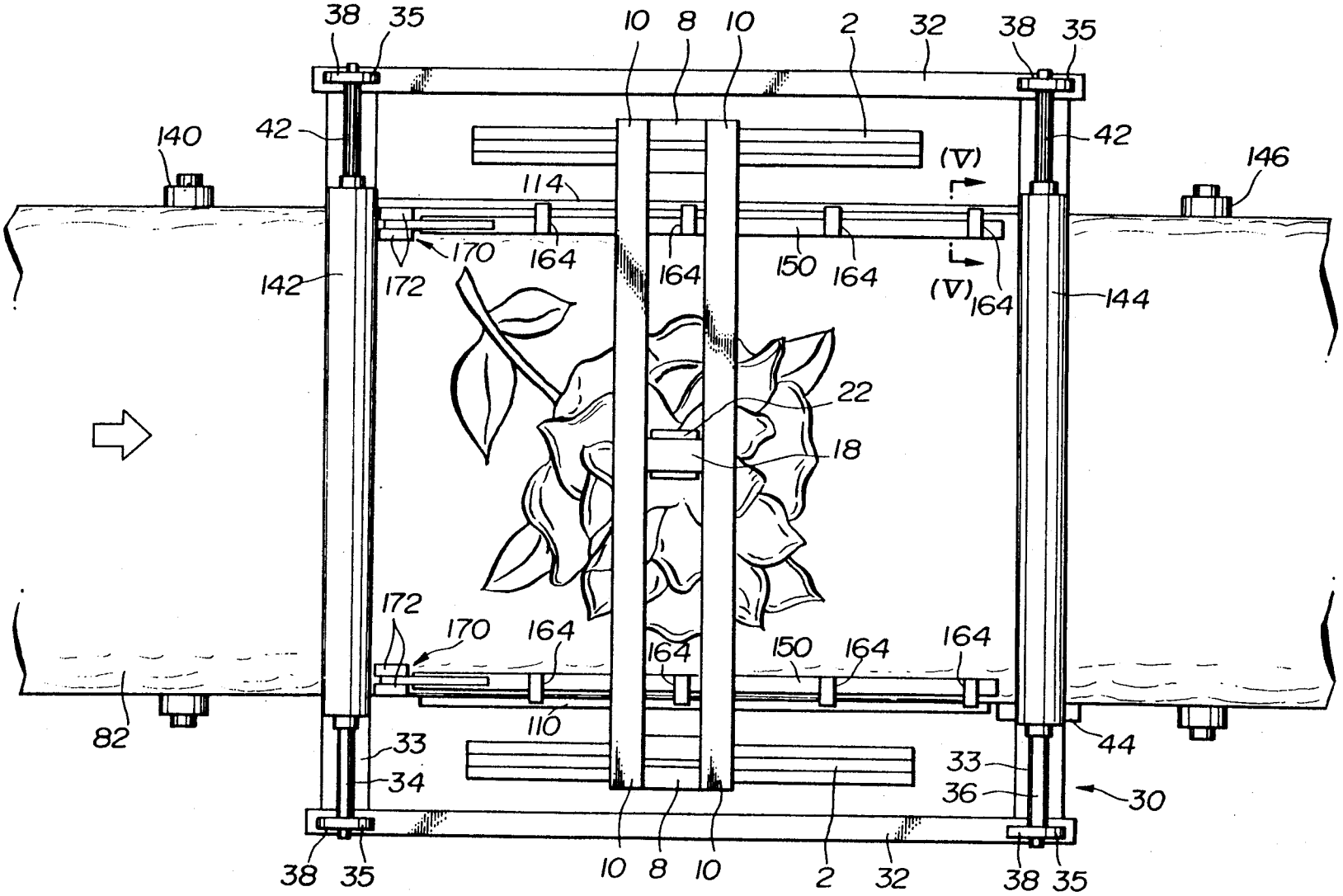
FIG. 2 is a schematic plan view showing a sewing machine including the fabric feeding apparatus shown in FIG. 1 when a futon comforter is placed thereon.

FIG. 1 is a schematic side sectional view showing a sewing machine including a fabric feeding apparatus for sewing machines according to a first embodiment of the present invention. FIG. 2 is a schematic plan view showing a sewing machine including the fabric feeding apparatus shown in FIG. 1 when a futon comforter is placed thereon. In the attached drawings, arrows indicate the feeding direction of the fabric. First, a sewing machine will be described. As shown in FIGS. 1 and 2, the sewing machine has a pair of beds 2 mounted on the floor, which are parallel to each other. A pair of first arms 4 which are parallel to each other and at the same level, slidably bridge beds 2 and are supported on beds 2 via sliding shoes 6. Each of the side walls 8 stand on first arms 4 at the location above beds 2. Side walls 8 are at same level and are parallel to each other. A pair of second arms 10 which are parallel to each other and at same level, bridge the side walls 8 and are supported on side walls 8. There is a large vertical interval between first and second arms 4 and 10. Third arm 12 is slidably supported on first arms 4 via sliding shoes 14. Bobbin (lower) assembly 16 of a sewing mechanism which includes a hook, a bobbin and so on, is mounted on third arm 12. Fourth arm 18 is slidably supported below second arms 10 via sliding shoes 20. Needle assembly (upper assembly) 22 of the sewing mechanism, which includes a needle, a thread tension guide, a thread feeder, and so on, is suspended by fourth arm 18. Shuttle and needle assemblies 16 and 22 can be moved along beds 2 because first arms 4 slidably bridge beds 2. Bobbin and needle assemblies 16 and 22 can be also moved across beds 2 because third arm 12 and fourth arm 18 slidably bridge first arms 4 and second arms 10, respectively. Bobbin and needle assemblies 16 and 22 are controlled so as to be always synchronizedly moved as such a manner that the assemblies are vertically aligned, thereby cooperated to sew the fabric which is placed at a position between the assemblies.

Figure 3:
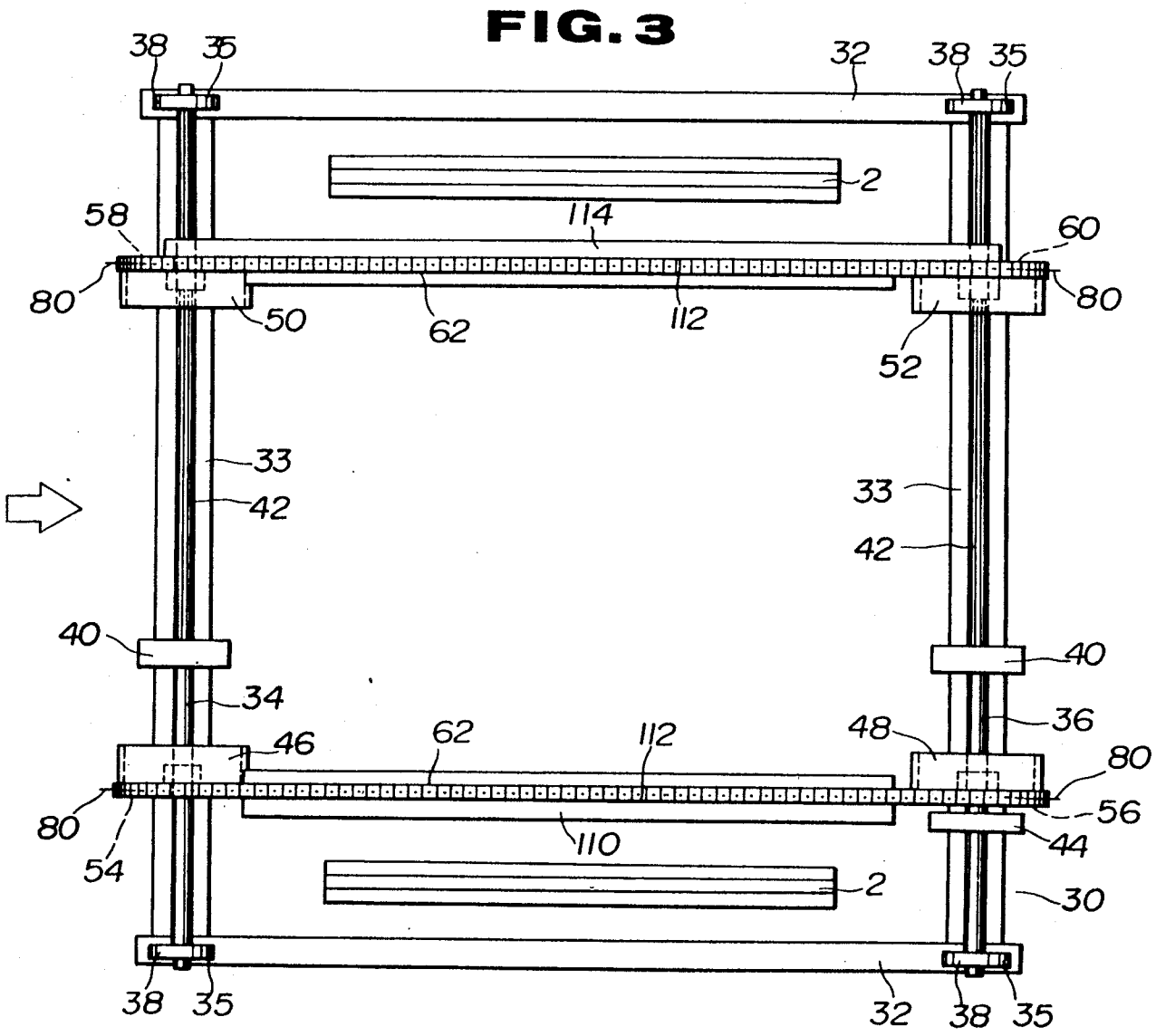
FIG. 3 is a schematic plan view of the fabric feeding apparatus shown in FIG. 2 without the futon comforter.

Next, a fabric feeding apparatus according to a first embodiment of the present invention will be described hereinafter. The fabric feeding apparatus is designed to set and withdraw the fabric into and from the position. As shown in FIG. 3, a supporting rectangular frame 30 which surrounds beds 2 of the sewing machine is mounted on the floor. A pair of side frame members 32 of frame 30 are disposed so as to be parallel to beds 2 and a pair of front and back frame members 33 connect frame members 32, thereby constituting rectangular frame 30. Each side frame member 32 has a pair of columns 35 at each end, including a rolling bearing 38. A pair of shafts 34 and 36 bridge side frame members 32 via rolling bearings 38. Shafts 34 and 36 are also supported by intermediate rolling bearings 40, respectively. Each of shafts 34 and 36 has spline 42 near one end of the shaft. Pulley 44 is mounted on shaft 36. A motor (not shown) rotates shafts 36 via a reducing gear box (not shown) and pulley 44. Drums 46 and 48 are affixed to the non-spline portions of shafts 34 and 36, respectively. Splines 42 are inserted into similar sized drums 50 and 52, respectively. Also, sprocket wheels 54 and 56 are affixed to non-spline portions of shafts 34 and 36, respectively. Splines 42 are inserted into similar sized sprocket wheels 58 and 60, respectively. Therefore, sprocket wheels 54 and 56; and 58 and 60 constitute two sets of the wheels that can be disposed respectively at the opposite side of the sewing machine. A pair of transmission chains 62 are tensionally wrapped around sprocket wheels 54 and 58; and 56 and 60, respectively. Therefore, with rotation of the unshown motor to rotate pulley 44, chains 62 move around those wheels and move in same direction with each other. Each of chains 62 is disposed in a vertical plane.

Figure 4:
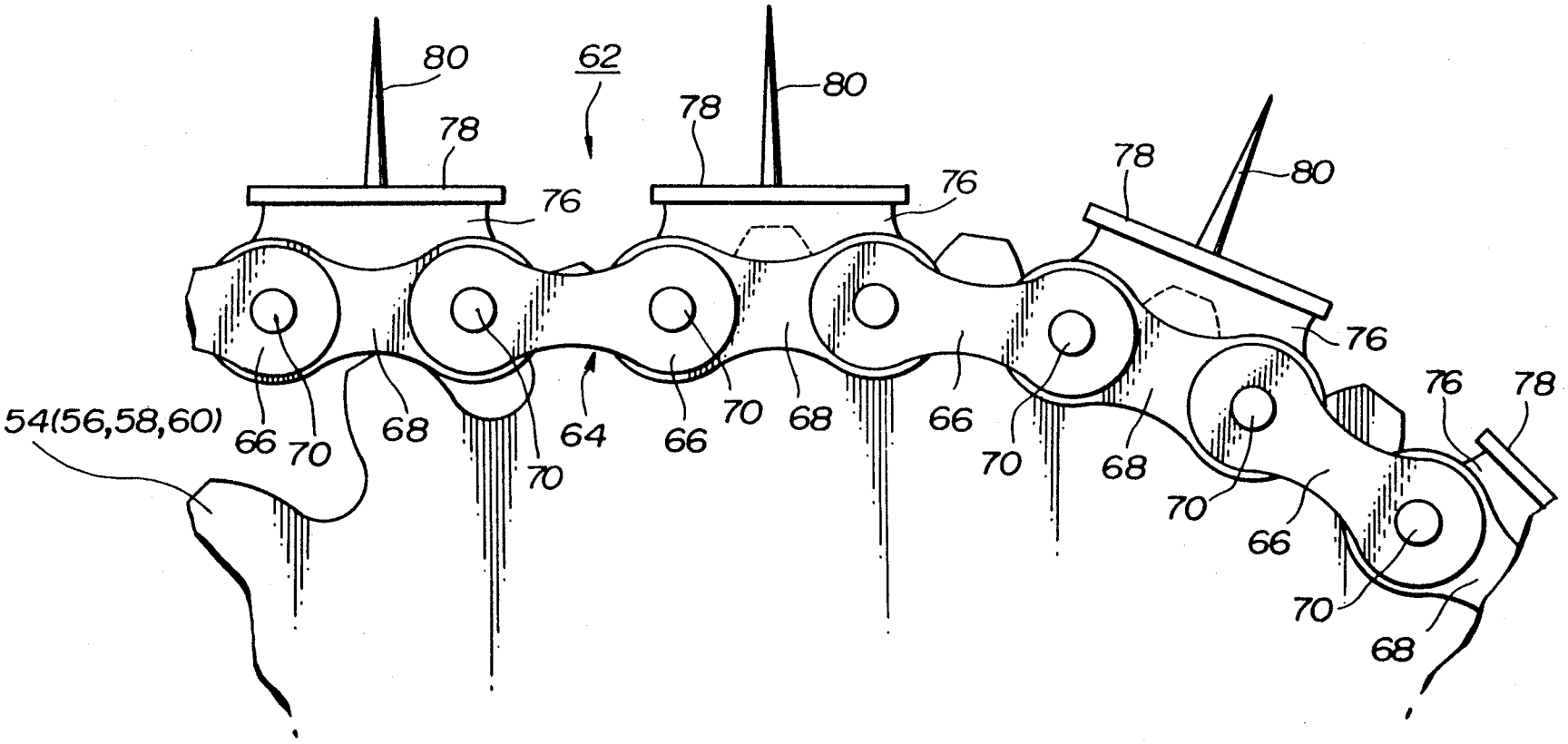
FIG. 4 is a side view showing selected portion of a chain and sprocket wheel used in a fabric feeding apparatus shown in FIGS. 1, 2, and 3.
Figure 5:
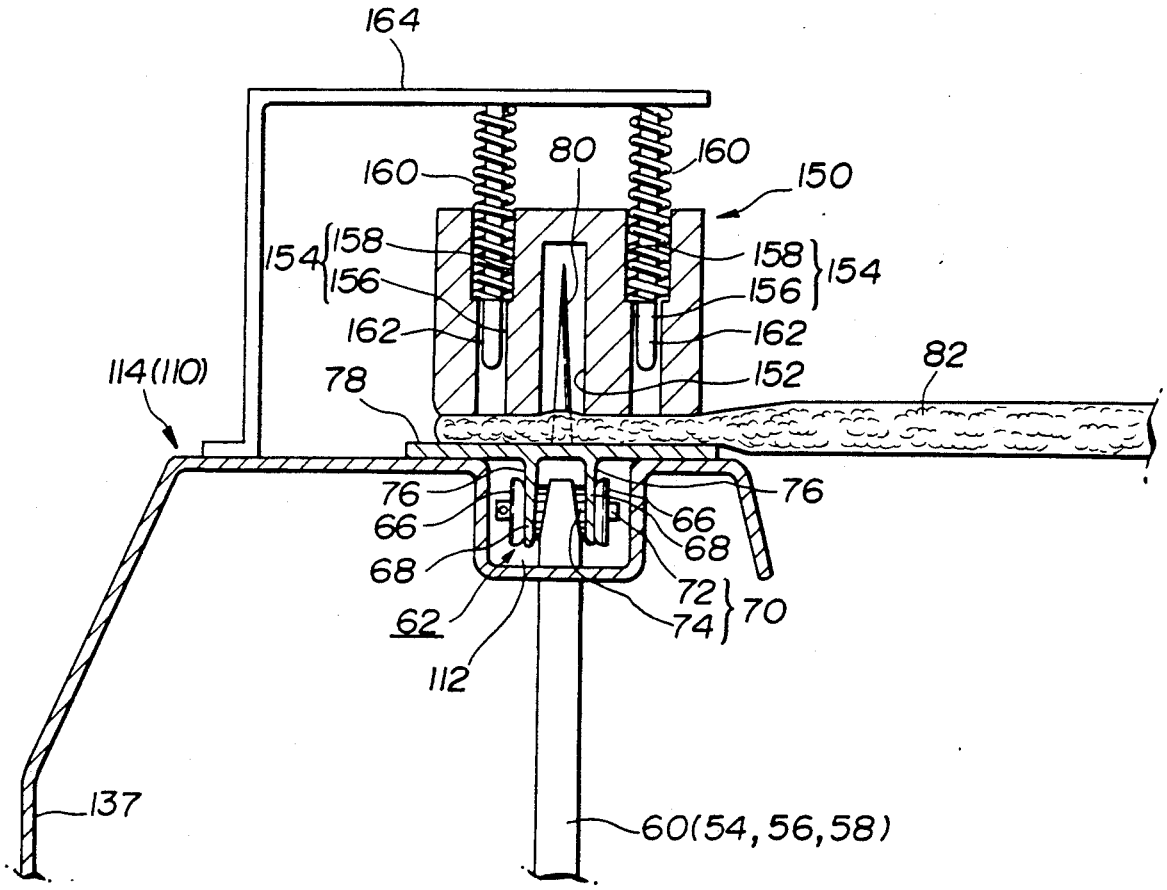
FIG. 5 is an enlarged sectional view showing near the chain of a fabric feeding apparatus along the V—V line in FIG. 2.

Each chain 62 is constituted in such a manner as shown in FIGS. 4 and 5. Chain 62 includes ordinal roller chain 64. Roller chain 64 includes a plurality of pairs of alternative pin link plates 66 and roller link plates 68 and rollers 70 which connects plates 66 and 68. Rollers 70 includes pins 72 and bushes 74. Chain 62 further includes a plurality of pairs of supporting plates 76. Supporting plates 76 are attached to roller link plates 68. Each pair of supporting side plates 76 support ceiling plate 78. Ceiling plate 78 includes spike 80 on its outside surface. The radial movement of chain 62 against sprocket wheel 54 (56, 58, or 60) is not interfered with because supporting side plates 76 are attached to roller link plates 68.

Figure 6:
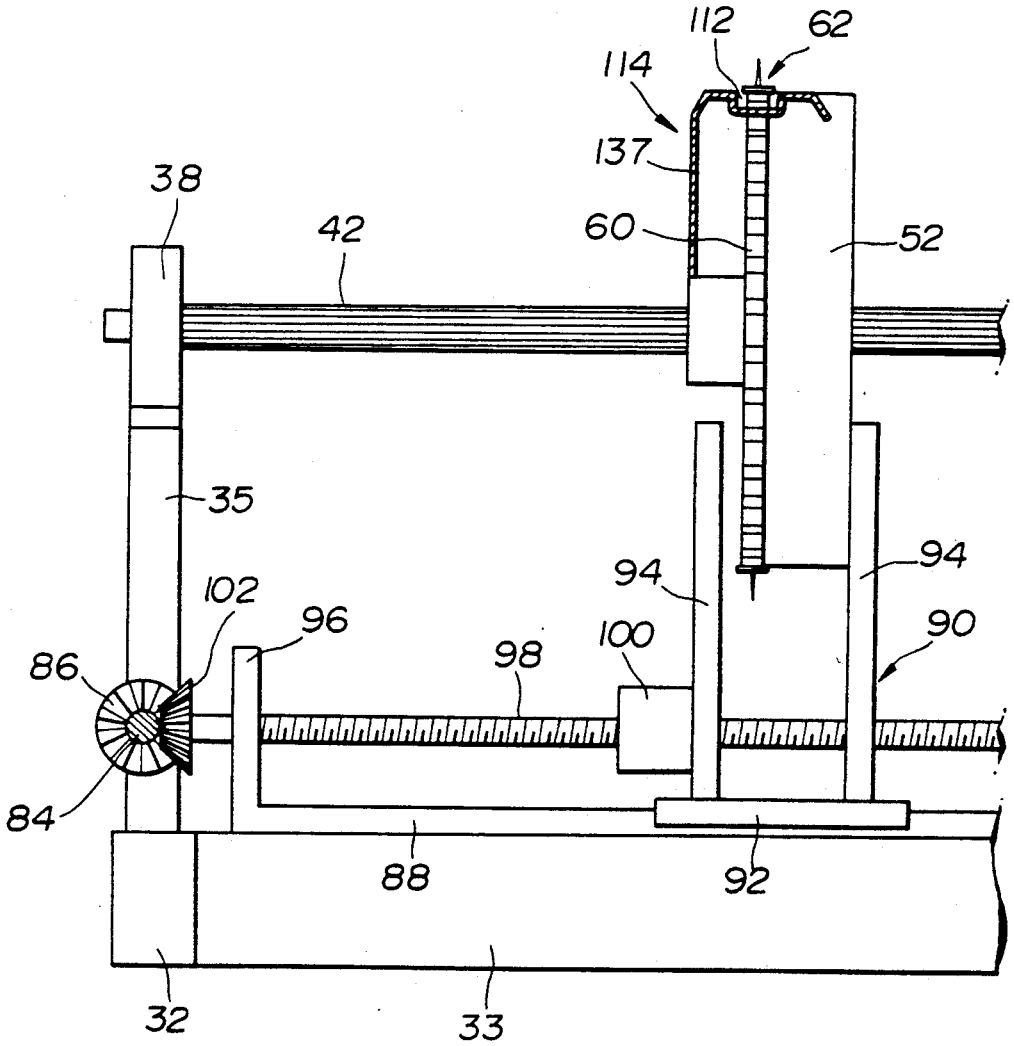
FIG. 6 is a side view showing selected portion of a tension system of a fabric feeding apparatus along the V—V line in FIG. 2.

Elongated futon comforter 82 (shown in FIGS. 1 and 2) is placed on drums 46, 48, 50, and 52 and both hems of futon comforter 82 are pierced by pairs of spikes 80. The fabric feeding apparatus further includes a tension system for futon comforter 82 as shown in FIG. 6. A motor (not shown) is equipped on side frame member 32. Motor shaft 84 of the motor connects to bevel gear 86. Guide rail 88 which is parallel to spline 42 of shaft 36 is mounted on back frame member 33. Wheel mover 90 which is put on guide rail 88 can slide along guide rail 88, horizontally. Wheel mover 90 has a sliding plate 92 which slides on guide rail 88, and a pair of lateral plates 94 which stands on sliding plate 92 and extends to lateral surfaces of sprocket wheel 60 and drum 52. Lateral plates 94 which faces each other are spaced apart at an interval which is slightly wider than sprocket wheel 60 plus drum 52. A pair of standing plates 96 (one is shown and another is not shown) including a rolling bearing are mounted on both ends of guide rail 88. Screw shaft 98 bridges standing plates 96 and engages with the rolling bearings. One of the lateral plates 94 has ball nut 100 which engages with screw shaft 98, so that ball nut 100 and screw shaft 98 constitute a ball screw mechanism. One end of screw shaft 98 extends to outward from standing plate 96 and then is affixed to bevel gear 102. Bevel gears 86 and 102 are engaged with each other. Therefore, by rotating the motor, shaft 84 spins, screw shaft 98 spins, wheel mover 90 slides along guide rail 88, and drum 52 and sprocket wheel 60 slide along spline 42. While the above tension system for a futon comforter can move drum 52 and sprocket wheel 60, the same tension system which can move drum 50 and sprocket wheel 58 (see FIG. 3) is installed. Accordingly, the locations of drum 52 and sprocket wheel 60; and drum 50 and sprocket wheel 58 can be suitably adjusted to stretch or slacken the futon comforter, thereby giving futon comforter 82 an adequate lateral tension force.

As shown in FIG. 3, along chain 62 which is wrapped around stationary sprocket wheels 54 and 56, elongated chain supporter 110 is mounted on the floor. Chain supporter 110 includes receiving groove 112 for chain 62. The upper tensed portion of chain 62 is received by receiving groove 112, so as to be horizontal, and slides in receiving groove 112. Elongated chain supporter 114 is secured to splines 42 along chain 62 which is wrapped around slidable sprocket wheels 58 and 60. Chain supporter 114 also includes receiving grooves 112 for chain 62. When futon comforter 82 is fed, chain supporters 110 and 114 receive the weight of futon comforter 82 and retain the upper tensed portion of chains 62 in a horizontal position.

Figure 7:
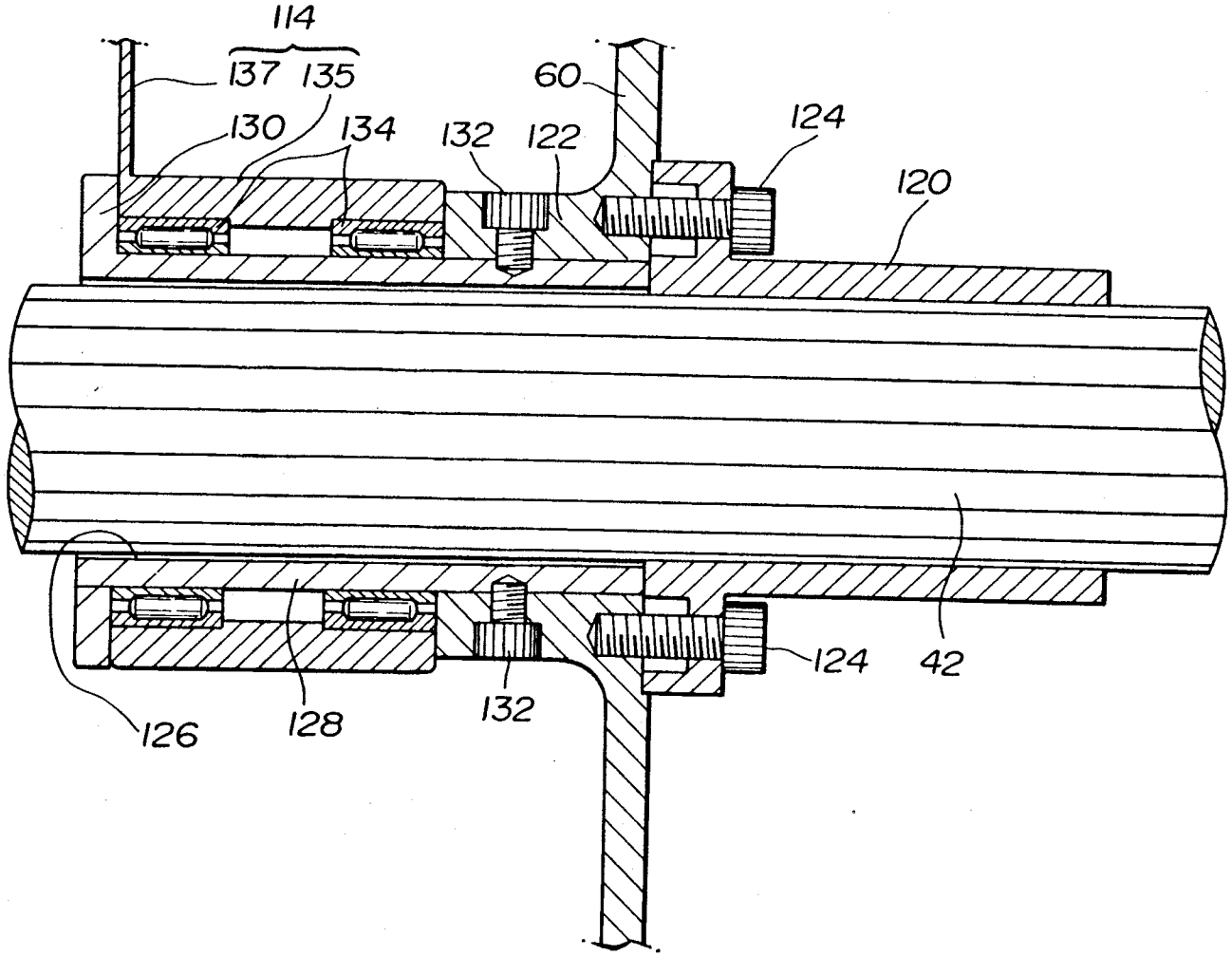
FIG. 7 is an enlarged sectional view of FIG. 6.

The relationship between chain supporter 114 and other elements are shown more specifically in FIGS. 5 and 7. As shown in FIG. 7, spline 42 engages with spline bush 120. Spline bush 120 is affixed to boss 122 of sprocket wheel 60 by bolts 124. Therefore, with rotating spline 42, sprocket wheel 60 can rotate. Spline 122 is inserted into hole 126 of pipe-shaped rolling shoe 128 which has flange 130. Hole 126 is of larger diameter than the major diameter of spline 122, and thereby does not receiving rotating force from spline 122 directly. Rolling shoe 128 and boss 122 of sprocket wheel 60 are fixed by bolts 132. Needle bearings 134 enclose the peripheral surface of rolling shoe 128, and are held by flange 130 of rolling shoe 128 and boss 122 of sprocket wheel 60. Chain supporter 114 has boss 135 and lateral wall 137 which is perpendicularly affixed to boss 135. Boss 135 is mounted on needle bearings 132. Therefore, rotating force of spline 42 is transmitted not to chain supporter 114 but to sprocket wheel 60 and drum 52 (not shown in FIG. 7). Furthermore, with axial movement of sprocket wheel 60, chain supporter 114 can be moved together.

Chain supporter 114 is secured to spline 42 of shaft 36 and to sprocket wheel 60 in the above fashion. Chain supporter 114 has another boss 135 also secured to spline 42 of shaft 34 and to sprocket wheel 58 (see FIG. 3) in a similar fashion. Therefore, chain supporter 114 can be moved along shafts 34 and 36, that is, receiving groove 112 of chain supporter 114 can always be moved to the location where groove 112 can receive chain 62 as shown in FIG. 5. More precisely, groove 112 receives chain 62 and chain supporter 114 supports ceiling plate 78 of chain 62. The weight of futon comforter 82 is also supported by chain supporter 114.

As shown in FIGS. 1 and 2, feeding rollers 140 and 142 which are parallel to shaft 34 are installed for providing appropriate piercing by spikes 80. This means that holes of minimum size are caused by spikes 80 or other more extensive damage. Feeding roller 142 is installed generally just above shaft 34. Feeding roller 140 is installed above and to the left of feeding roller 142. Futon comforter 82 is fed from the left side to the right side in FIGS. 1 and 2. Feeding rollers 144 and 146 which are parallel to shaft 36 are installed for appropriate removal of futon comforter 82 from spike 80, thereby preventing futon comforter 82 from receiving unexpected extensive damage. Feeding roller 144 is installed generally just above shaft 36. Feeding roller 146 is installed above and to the right of feeding roller 144. Futon comforter 82 passes over roller 140 and under roller 142. When spike 80 stands vertically, spike 80 begins to pierce futon comforter 82. Therefore, the appropriate piercing is provided. After feeding on chains 62, futon comforter 82 passes under roller 144 and over roller 146. Before spike 80 inclines, spike 80 releases futon comforter 82. Therefore, the appropriate removal is provided.

Elongated safety covers 150, which are extending from sprocket wheel 54 to sprocket wheel 56, or extending from sprocket wheel 58 to sprocket wheel 60, are placed on the upper tensed portions of chains 62 for preventing operators from injury by spikes 80. One of the safety covers 150 is specifically shown in FIG. 5. The safety cover 150 includes perpendicular groove 152 opening below for spikes 80 passing therethrough. Perpendicular pairs of holes 154 are aligned in safety cover 150. Each of holes 154 includes a lower small diameter portion 156 and an upper large diameter portion 158. Springs 160 are inserted into the large diameter portions 158 and are supported by the edges of small diameter portions 156, respectively. Core pins 162 are inserted into springs 160, one by one. L-shaped pressers made of thin metal plates 164 are attached to chain supporters 114. Core pins 162 are affixed to pressers 164. Springs 160 are pressed between the edges and pressers 164. One of hems of the futon comforter 82 and the ceiling plates 78 of transmission chain 62 are sandwiched between safety cover 150 and chain supporter 114 (or 110).

Therefore, both safety covers 150 function as fasteners for futon comforter 82, which cooperate with spikes 80. Because safety covers 150 function as fasteners, lateral tension force to spikes 80 is moderated, and spikes 80 and sprocket wheels 54, 56, 58, and 60 are maintained perpendicular. Consequently, chains 62 are prevented from falling off from the sprocket wheels. For smooth feeding of futon comforter 82, safety covers 150 are made of low friction material, such as poly-tetra-fluoro-ethylene.

For further smooth feeding of futon comforter 82 under safety covers 150, as shown in FIGS. 1 and 2, a pair of weight rollers 170 are installed near sprocket wheels 54 and 58, respectively. Each weight roller 170 includes a pair of wheels 172 and a shaft 174. Wheels 172 of each weight roller 170 are spaced apart to spread over pins 80 so as to prevent contact with pins 80. When feeding futon comforter 82, wheels 172 rotate and press down futon comforter 82.

As mentioned above, the fabric feeding apparatus for sewing machines in accordance with the first embodiment of the present invention can provide continuous feeding of the fabric into the sewing machine, so that time for preparing and unfastening the fabric for the sewing machine is reduced. The apparatus can provide firm and constant holding force to the fabric to be sewn because it uses spikes 80 as holders. If more holding force is necessary, chains 62 may be substituted by similarly formed chains which have smaller pin link plates 66, roller link plates 68, rollers 70, supporting side plates 76, and ceiling plates 78. Therefore, the number of spikes 80 and number of spikes 80 per length can be increased, thereby the holding force and holding force per length can be increased. (In the conventional way, the number of clasps is limited.) Spikes 80 need less hems of the fabric in order to hold the fabric as compared with conventional clasps like clothespins. Wasted cloth can thereby be reduced. The apparatus further provides lateral tension to the fabric because it uses the sprocket mechanism. Even if the fabric shrinks, the apparatus can constantly provide enough lateral tension.

Figure 8:
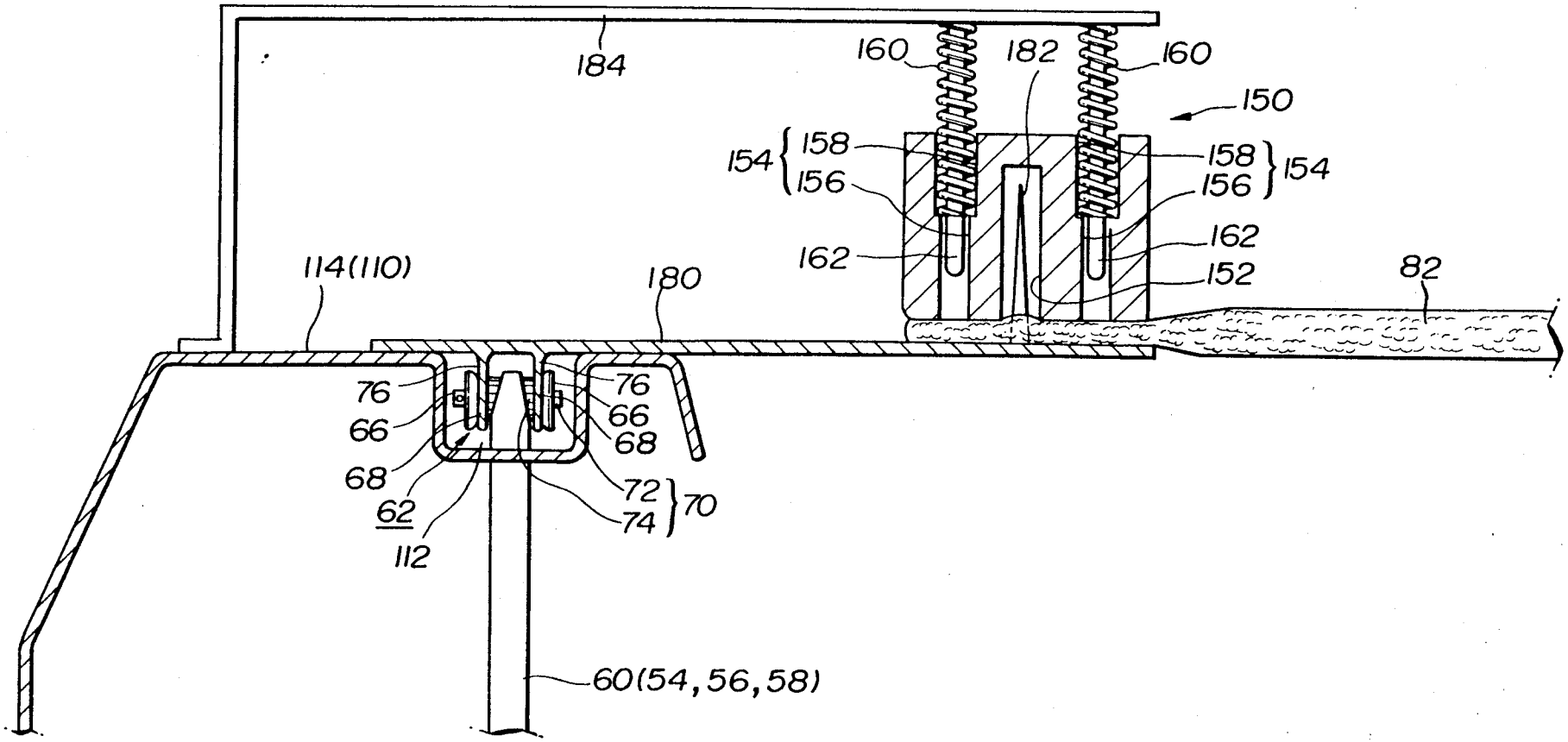
FIG. 8 is a sectional view showing the chain of the fabric feeding apparatus according to a second embodiment of the present invention.

A second embodiment of the present invention will be described hereinafter. As shown in FIG. 8, chain 62 has wide ceiling plates 180 instead of ceiling plates 78 (shown in FIG. 5) of the first embodiment. Ceiling plates 180 extend inward toward the feeding apparatus. Spikes 182 are affixed near the inward end of ceiling plates 180, respectively, in such a manner that spike 182 perpendicularly stands on ceiling plates 180. Horizontal plates 184 are affixed to chain supporter 114. A ceiling of pressers 184 extend just above the inward ends of ceiling plates 180. Safety cover 150 is supported by pressers 184 in the same manner as in the first embodiment, in which safety cover 150 is supported by pressers 164. Safety cover 150 prevents the operator from injury and acts as a fastener for futon comforter 82 similar to the first embodiment. Ceiling plates 180 and the ceiling of presser 184 extend inward. Safety cover 150 acts at a location that is more inward than the first embodiment of FIG. 5. Thus, bobbin assembly 16 of the sewing machine, which moves under futon comforter 82, can move relatively outward, avoiding contact with chain supporter 114 or chain 62. The area that the sewing machine can sew is broader than the first embodiment.

Figure 9:
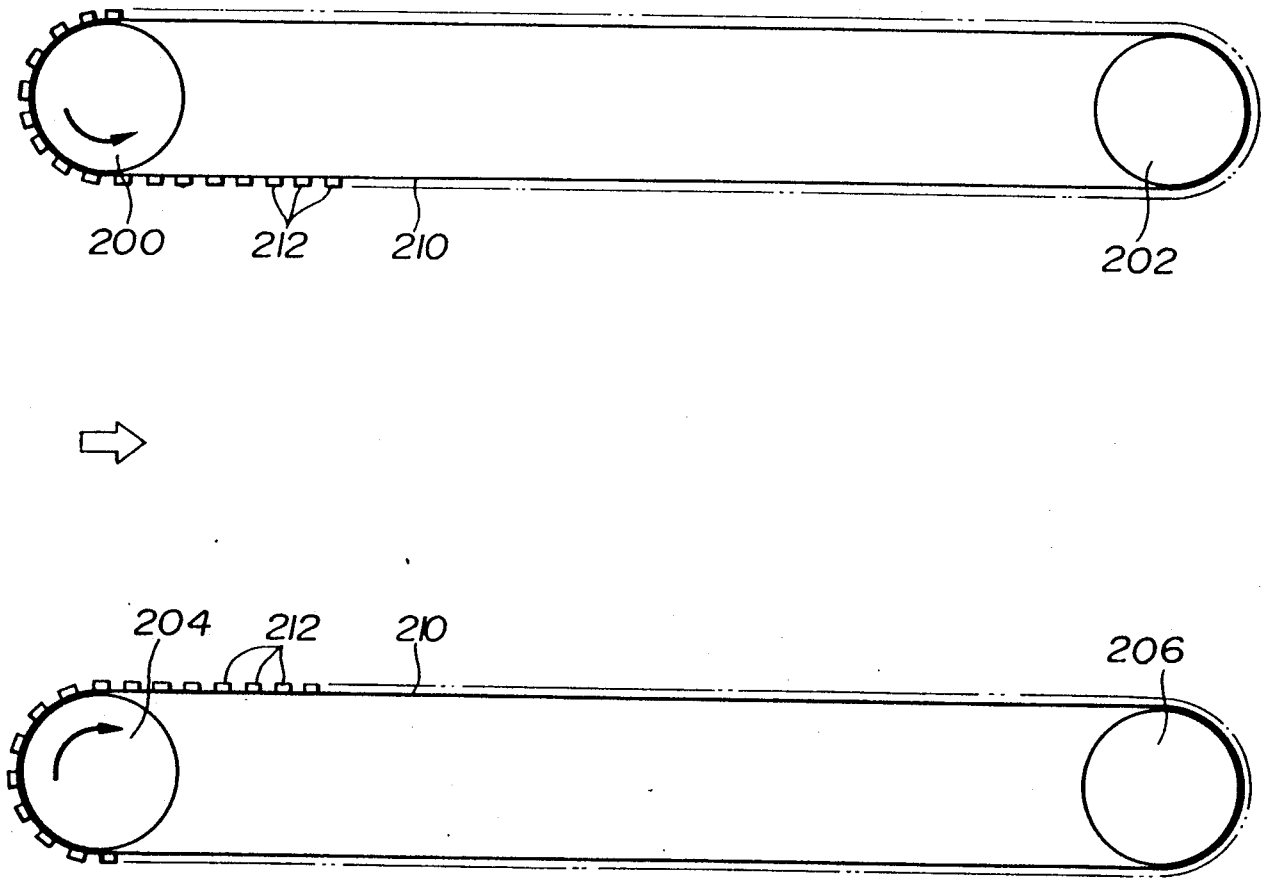
FIG. 9 is a schematic plan view showing a fabric feeding apparatus for a sewing machine according to a third embodiment of the present invention.
Figure 10:
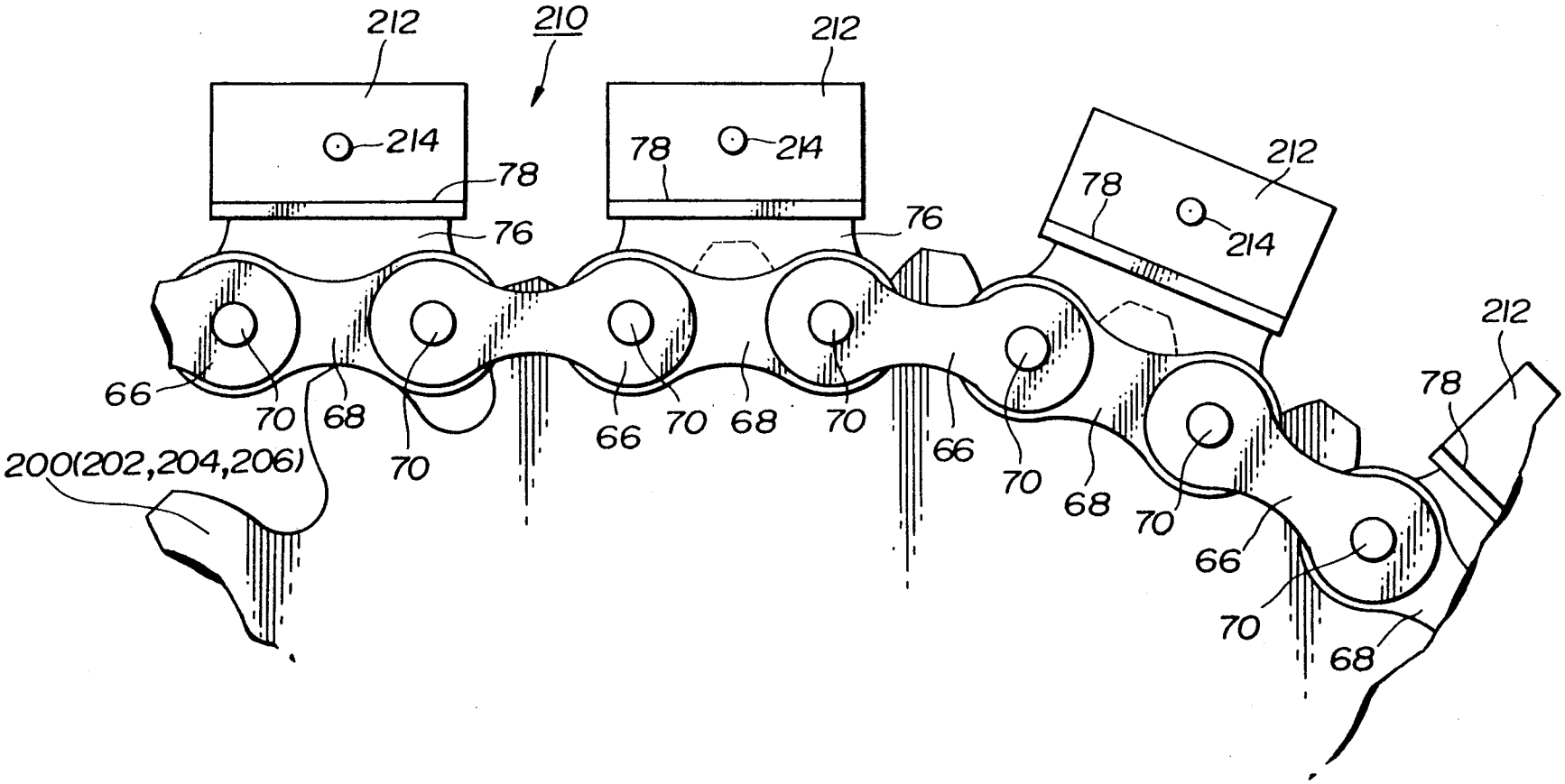
FIG. 10 shows an enlarged detail of a chain and sprocket wheel used in the fabric feeding apparatus shown in FIG. 9.

While the sprocket wheels are horizontally disposed in these embodiments, the sprocket wheels can be vertically disposed as a third embodiment as shown in FIG. 9. FIG. 9 is a schematic plan view of the third embodiment. Numeral 200, 202, 204, and 206 denote similar sized sprocket wheels which are parallel to each other and vertically supported. Sprocket wheels 200 and 202; and 204 and 206 constitute two sets of wheels that can be disposed respectively at the opposite sides of the sewing machine. Sprocket wheels are supported in a manner that their axes compose the apexes of a rectangle. A pair of chains 210 are tensionally wrapped around sprocket wheels 200 and 202; and 204 and 206, respectively. Both the chains 210 are disposed in a horizontal plane. Chains 210 are of generally same shape as chains 62 of the first embodiment. However, referring to FIG. 10, the spikes are not affixed to ceiling plates 78 directly. Futon receiving plates 212 are attached to ceiling plates 78, perpendicularly, so that each upper surface of futon receiving plates 212 are at the same level. Each futon receiving plates 212 has a spike 214 at its upper surface. Therefore, the fabric feeding apparatus for sewing machine of the third embodiment can feed fabrics in a condition such that the fabric is pierced by spikes 214. Needless to say, other elements described concerning the first embodiment may be installed in the apparatus, so as to have the same qualities as the first embodiment.

Figure 11:
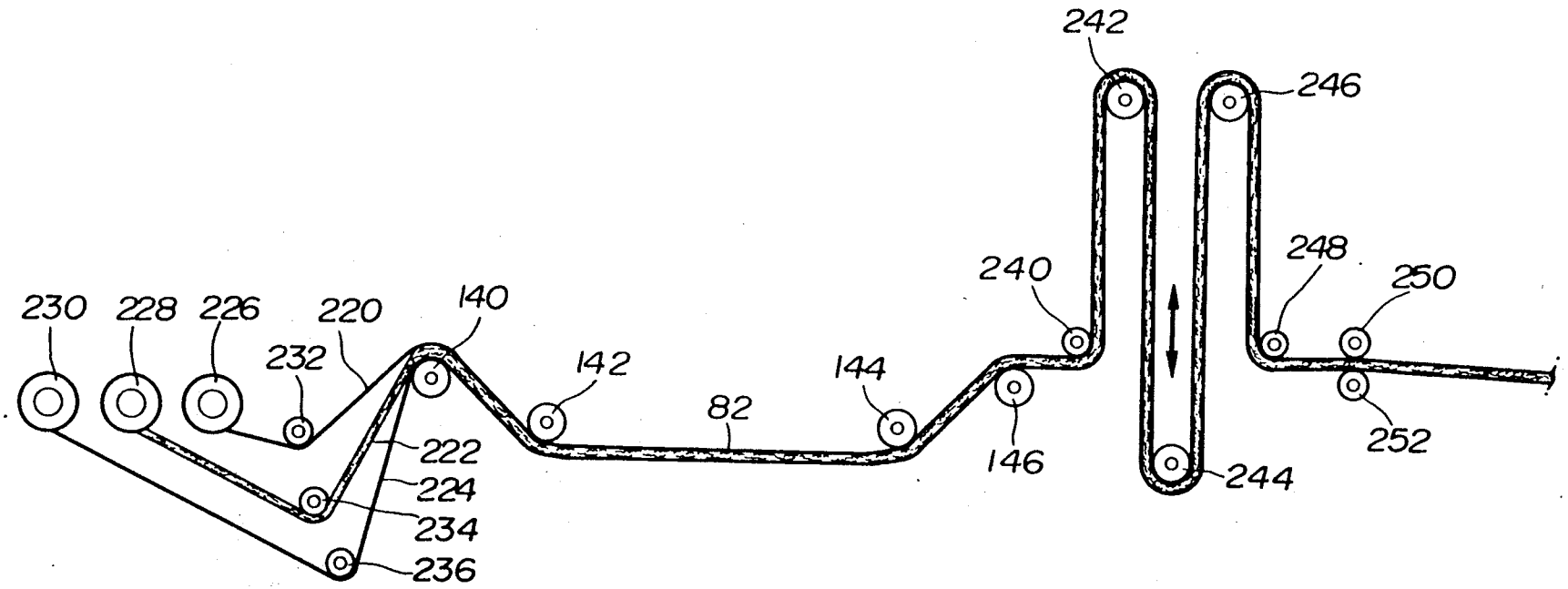
FIG. 11 is a schematic side view showing a manufacturing shop for futon comforters, which is suitable for the fabric feeding apparatus for sewing machines of the present invention.

The above mentioned fabric feeding apparatuses are advantageous, especially in the case when the apparatuses are utilized in a futon comforter manufacturing shop as shown in FIG. 11. In the figure, numeral 220, 222, and 224 designate front cloth, internal cotton, and back cloth, respectively, which are components of futon comforter 82. Supplying rollers 226, 228, and 230 supply front cloth 220, internal cotton 222, and back cloth 224, respectively. Front cloth 220, internal cotton 222, and back cloth 224 are then collected and laminated on previously described feeding roller 140 via rollers 232, 234, and 236, respectively. While passing between feeding rollers 142 and 144, front cloth 220, internal cotton 222, and back cloth 224 are sewn into a unitary futon comforter 82. After passing over feeding roller 146, futon comforter 82 passes around rollers 240, 242, 244, 246, and 248 which are disposed alternatively above and below. Thus, the rollers 242 and 246 constitute a first suspension means for suspending the textile fabrics including the front cloth 220, internal cotton 222 and back cloth 224 all now sewn into the unitary futon comforter 82, in such a manner that the fabrics extend between the rollers 242 and 246 of the first suspension means and the horizontal section of the loop path of the fabric feeding apparatus. The rollers 242 and 246 of the first suspension means are disposed at a level above the horizontal section of the feeding apparatus as shown in FIG. 11. A shaft of roller 244 is suspended so as to be movable up and down, thereby roller 242 acts as a cushion for feeding. Futon comforter 82 passes through between rollers 250 and 252, and then its cut off into pieces of the futon comforter. While the apparatuses are advantageous in the futon comforter manufacturing shop in the description, the apparatuses can feed a piece of futon comforter one by one.

What is claimed is:

1. An apparatus for feeding a sewing machine with textile fabrics, the apparatus comprising:

two sets of rotary wheels disposed at opposite sides of the sewing machine;

a pair of loop members wrapped respectively around the two sets of wheels so that elements of each of the loop members can move around the respective sets of wheels with at least one section of their path being horizontal, and spaced from and parallel to the horizontal section of the path of the other loop member's elements;

drive means, drivingly connected to one of each set of wheels, for driving the elements of the loop member synchronously with those of the other so that, within the horizontal sections of the paths, the loop member's elements are moved in the same direction;

a pair of holding means, mounted respectively on the loop members, for holding opposite side hems of the fabric to hold the fabric between the pair of holding means at the respective horizontal sections of the loop paths, each of the holding means including a plurality of spike members disposed around the corresponding loop member, the spike members being pointed upward when the spike members are in the corresponding horizontal section, so as to pierce the corresponding side hem of the fabric horizontally disposed;

adjusting means for adjusting the space between the horizontal sections of the paths so as to stretch or slacken the fabric held by the pair of holding means;

a first suspension means for suspending the textile fabric in such a manner that the fabric extends between the first suspension means and the horizontal section of the loop path, the suspension means being disposed at a level above the horizontal section of the fabric feeding apparatus; and a pair of covers which respectively cover over the pair of horizontal sections of the loop paths, the covers holding the fabric in contact with the spike members to hold the fabric.

2. A fabric feeding apparatus for sewing machines according to claim 1, wherein the covers are made of low friction material.

3. A fabric feeding apparatus for sewing machines according to claim 2, the apparatus further comprising a second suspension means for the fabric, the second suspension means located at a level above that of the horizontal section of said fabric feeding apparatus, the second suspension means suspending the fabric provided from said fabric feeding apparatus, in such a manner that the fabric bridges the second suspension means and the horizontal sections of the loop path.

4. A fabric feeding apparatus for sewing machines according to claim 3, wherein each of said loop members is disposed in a vertical plane.

5. A fabric feeding apparatus for sewing machines according to claim 4, wherein the elements of the loop members respectively include plate members attached to the elements, the plate members extending toward the plate members of the other loop member when the elements are in the corresponding horizontal sections.

6. A fabric feeding apparatus for sewing machines according to claim 3, wherein both the loop members are disposed in a horizontal plane.

* * * * *